US010792925B2

(12) United States Patent
Kuri

(10) Patent No.: US 10,792,925 B2
(45) Date of Patent: Oct. 6, 2020

(54) INK TANK, INK MEASURING SYSTEM, AND INK MEASURING METHOD

(71) Applicant: Seiko Epson Corporation, Tokyo (JP)

(72) Inventor: Ryohei Kuri, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/260,442

(22) Filed: Jan. 29, 2019

(65) Prior Publication Data

US 2019/0232672 A1 Aug. 1, 2019

(30) Foreign Application Priority Data

Jan. 30, 2018 (JP) ..... 2018-013703

(51) Int. Cl.
*B41J 2/175* (2006.01)
*B41J 2/195* (2006.01)

(52) U.S. Cl.
CPC ..... *B41J 2/17513* (2013.01); *B41J 2/17546* (2013.01); *B41J 2/17553* (2013.01); *B41J 2/17566* (2013.01); *B41J 2/195* (2013.01); *B41J 2002/17573* (2013.01)

(58) Field of Classification Search
CPC ..... B41J 2/17513
See application file for complete search history.

(56) References Cited

U.S. PATENT DOCUMENTS 5,241,189 A 8/1993 Vandagriff et al.
6,012,794 A * 1/2000 Nakano ..... B41J 2/17513 347/7
8,042,928 B2 10/2011 Hongo et al.
2005/0156984 A1 7/2005 Uejima et al.
2005/0270347 A1* 12/2005 Yamamoto ..... B41J 2/17513 347/86
2007/0115314 A1 5/2007 Kondo et al.
2007/0159505 A1* 7/2007 Yamamoto ..... B41J 2/17566 347/7
2009/0207199 A1 8/2009 Yamamoto

FOREIGN PATENT DOCUMENTS

EP 1247648 A2 10/2002
JP H07-237300 A 9/1995
JP 08258280 A * 10/1996
(Continued)

OTHER PUBLICATIONS

Machine generated English translation of JP 08258280A to Suzuki, "Ink Residual Amount Detector of Image Forming Apparatus"; retrieved via https://worldwide.espacenet.com/ on Feb. 3, 2020; 8pp.*
(Continued)

*Primary Examiner* — Shelby L Fidler
(74) *Attorney, Agent, or Firm* — Harness, Dickey & Pierce, P.L.C.

(57) ABSTRACT

An ink cartridge includes a tank main body that contains ink, a transparent member that forms at least part of the tank main body and transmits light, and a reference plate that is disposed in the tank main body and in a position facing the transparent member and forms, along with the transparent member, an inflow space which is located between the transparent member and the reference plate and into which the ink flows.

3 Claims, 11 Drawing Sheets

(56) References Cited

FOREIGN PATENT DOCUMENTS

| | | | |
|---|---|---|---|
| JP | H08-340432 | A | 12/1996 |
| JP | 2001-211337 | A | 8/2001 |
| JP | 2005-231356 | A | 9/2005 |
| JP | 2015-196339 | A | 11/2015 |
| WO | WO-2016-175862 | A1 | 11/2016 |

OTHER PUBLICATIONS

Extended European Search Report for Patent Application No. EP 19153937.8 dated Jun. 4, 2019 (10 pages).

* cited by examiner

INK TANK, INK MEASURING SYSTEM, AND INK MEASURING METHOD

BACKGROUND

1. Technical Field

The present invention relates to an ink tank and further relates to an ink measuring system and an ink measuring method using the ink tank.

2. Related Art

An inkjet printer of related art incorporates an ink tank (such as ink cartridge) for supplying ink. The concentration of the ink in the ink tank changes over time due, for example, to volatilization of the solvent in the ink and precipitation of the pigment in the ink. Further, the concentration of the ink in the ink tank varies before and after the ink tank is exchanged in some cases due, for example, to the difference in the lot in which the ink tank was manufactured.

JP-A-2001-211337 discloses that the color of the ink in an ink tank is measured to handle a change in color reproducibility resulting from a change in the ink concentration. Specifically, the ink chamber in the ink tank is filled with an ink absorber, and the ink absorber is allowed to absorb the ink. The ink absorber is then irradiated with light through a transparent window of the ink tank, and the light reflected off the ink absorber is detected with a color sensor.

In a case where the concentration of the ink in the ink tank differs from an intended value or the components of the ink differ from intended components, failure of the inkjet printer or the ink tank occurs, or a desired printed result is not obtained in some cases. It is therefore desirable to measure the color or components of the ink to manage the quality of the ink.

In JP-A-2001-211337, however, since the light reflected off the ink absorber is detected, it is difficult to measure the inherent color or components of the ink. Further, in a case where the ink absorber deteriorates, the reflectance of the light reflected off the ink absorber changes, so that the color or components of the ink cannot be accurately measured.

SUMMARY

An advantage of some aspects of the invention is to provide an ink tank, an ink measuring system, and an ink measuring method capable of accurately measuring the color or components of ink.

An ink tank according to an application example of the invention includes a tank main body that contains ink, a transparent member that forms at least part of the tank main body and transmits light, and a reference plate that is disposed in the tank main body and in a position facing the transparent member and forms, along with the transparent member, an inflow space which is located between the transparent member and the reference plate and into which the ink flows.

In the ink tank according to the application example, the inflow space is formed between the transparent member and the reference plate of the tank main body. Therefore, the ink having flowed into the inflow space can be irradiated with light through the transparent member, and the light reflected off the reference plate can be detected through the transparent member for measurement of the color and components of the ink. The reference plate is a plate having reflectance known for each wavelength (18% standard plate or white reference plate, for example).

According to the application example, since no ink absorber in the related art is used, the inherent color or components of the ink can be accurately measured.

In the ink tank according to the application example, it is preferable that a width of the inflow space in a direction perpendicular to the reference plate is greater than or equal to 0.2 μm but smaller than or equal to 5.0 μm.

In general, the particles of ink used in an inkjet printer has a size of about 0.2 μm at the maximum. Therefore, in the application example with the configuration described above, setting the width of the inflow space between the transparent member and the reference plate at a value greater than or equal to 0.2 μm allows the ink to flow into the inflow space.

Further, the ink used in an inkjet printer has poor optical transmittance even in a case where the ink has a pale color but in a case where the ink has a film thickness greater than 5.0 μm. In view of this, in the application example with the configuration described above, the width of the ink-inflow space (film thickness of ink that flows into the inflow space) is set at a value smaller than or equal to 5.0 μm. The amount of light reflected off the reference plate can thus be large enough for the measurement of the accurate color of the reflected light.

Therefore, in the application example with the configuration described above, the color of the ink in the ink tank can be accurately and reliably measured.

In the ink tank according to the application example, it is preferable that the transparent member is disposed at a bottom section of the tank main body.

In the application example with this configuration, the bottom section of the tank main body is a section that faces downward in the vertical direction when the ink tank is incorporated. The ink-inflow space formed on the side facing the bottom section of the tank main body therefore allows the ink to readily flow into the ink-inflow space even in a case where the amount of ink in the ink tank has decreased. The color and components of the ink in the ink tank can therefore be more reliably measured.

It is preferable that the ink tank according to the application example further includes a pair of transparent substrates that sandwich the reference plate.

In the application example with this configuration, the pair of transparent substrates can prevent the effect of the solvent of the ink and other substances on the reference plate, whereby deterioration of the reference plate can be avoided. The color and components of the ink in the ink tank can therefore be accurately measured for a long period. The transparent substrates can each, for example, be a quartz crystal substrate having strong resistance to the effect of the solvent.

An ink measuring system according to an application example of the invention is an ink measuring system including any of the ink tanks described above and an ink measuring apparatus in which the ink tank is incorporated, and the ink measuring apparatus includes a light source that radiates light toward the transparent member, a light receiver that receives the light reflected off the reference plate, a calculator that calculates reflectance of the light based on an output from the light receiver, and a quality evaluator that evaluates quality of the ink based on the reflectance.

The ink measuring system according to the application example, which includes the ink tank described above, can accurately measure the inherent color or components of the ink in the ink tank. The quality of the ink can therefore appropriately managed.

In the ink measuring system according to the application example, it is preferable that the calculator converts the reflectance into concentration, normalizes the concentration, and converts the normalized concentration back into reflectance to calculate normalized reflectance, and that the quality evaluator evaluates a color or a component of the ink based on the normalized reflectance.

The ink measuring system according to the application example with this configuration can invariably evaluate the ink even in a case where the inclination of the installed ink measuring apparatus and the amount of remaining ink in the ink tank vary.

An ink measuring method according to an application example of the invention is an ink measuring method using any of the ink tanks described above, the method including radiating light toward the transparent member and measuring reflectance of the light reflected off the reference plate and evaluating a color or a component of the ink based on the reflectance.

The ink measuring method according to the application example, in which the ink tank described above is used, allows accurate evaluation of the ink in the ink tank and can therefore appropriately manage the quality of the ink.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described with reference to the drawings.

Configuration of Printer

Figure 1:
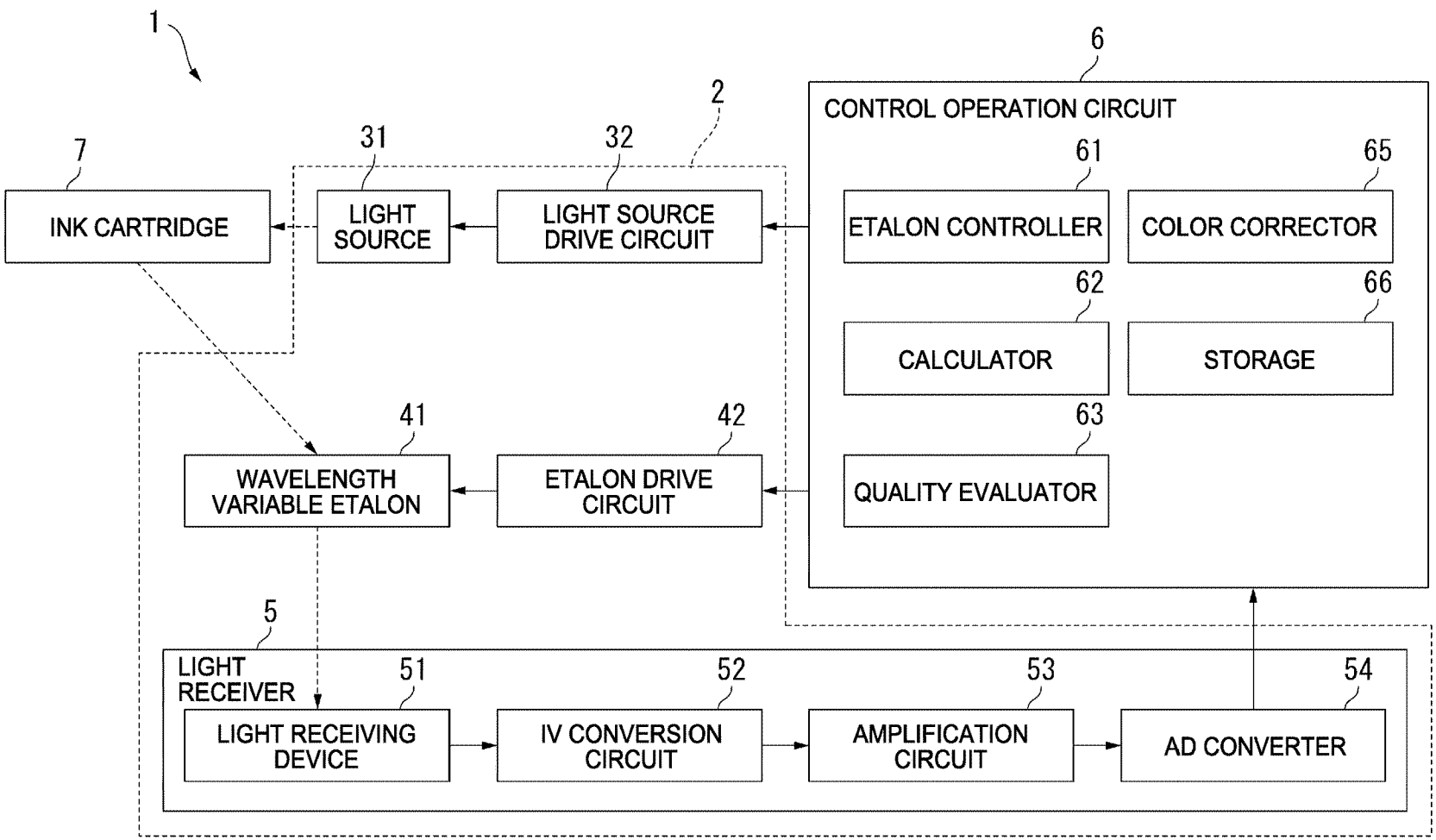
FIG. 1 is a diagrammatic view showing an ink measuring system according to an embodiment of the invention.

An ink measuring system 100 includes a printer 1 (inkjet printer), which is the ink measuring apparatus according to an aspect of the invention, and an ink cartridge 7, which is incorporated in the printer 1, as shown in FIG. 1.

The printer 1 according to the embodiment is an apparatus that transports a medium, such as a sheet to be printed, to a predetermined position and causes a printing section to discharge ink onto the transported medium to form an image on the medium. The printer 1 includes a cartridge incorporating section 20 and supplies the printing section with ink in the ink cartridge 7 accommodated in the cartridge incorporating section 20 to form an image on the medium. The printer 1 can measure the quality (color and components, for example) of the ink in the ink cartridge 7 and notify a user of whether or not the ink in use is appropriate in accordance with the result of the measurement.

The configurations of the mechanism that transports the medium, the printing section, and the mechanism that drives the printing section in the printer 1 can be known configurations and will not be described. In the following sections, the configuration relating to the ink measurement performed by the printer 1 will be primarily described.

The printer 1 includes the cartridge incorporating section 20, in which the ink cartridge 7 is incorporated, a measurement device 2, which is disposed in the cartridge incorporating section 20, and a control operation circuit 6, which controls the action of the printer 1.

Figure 2:
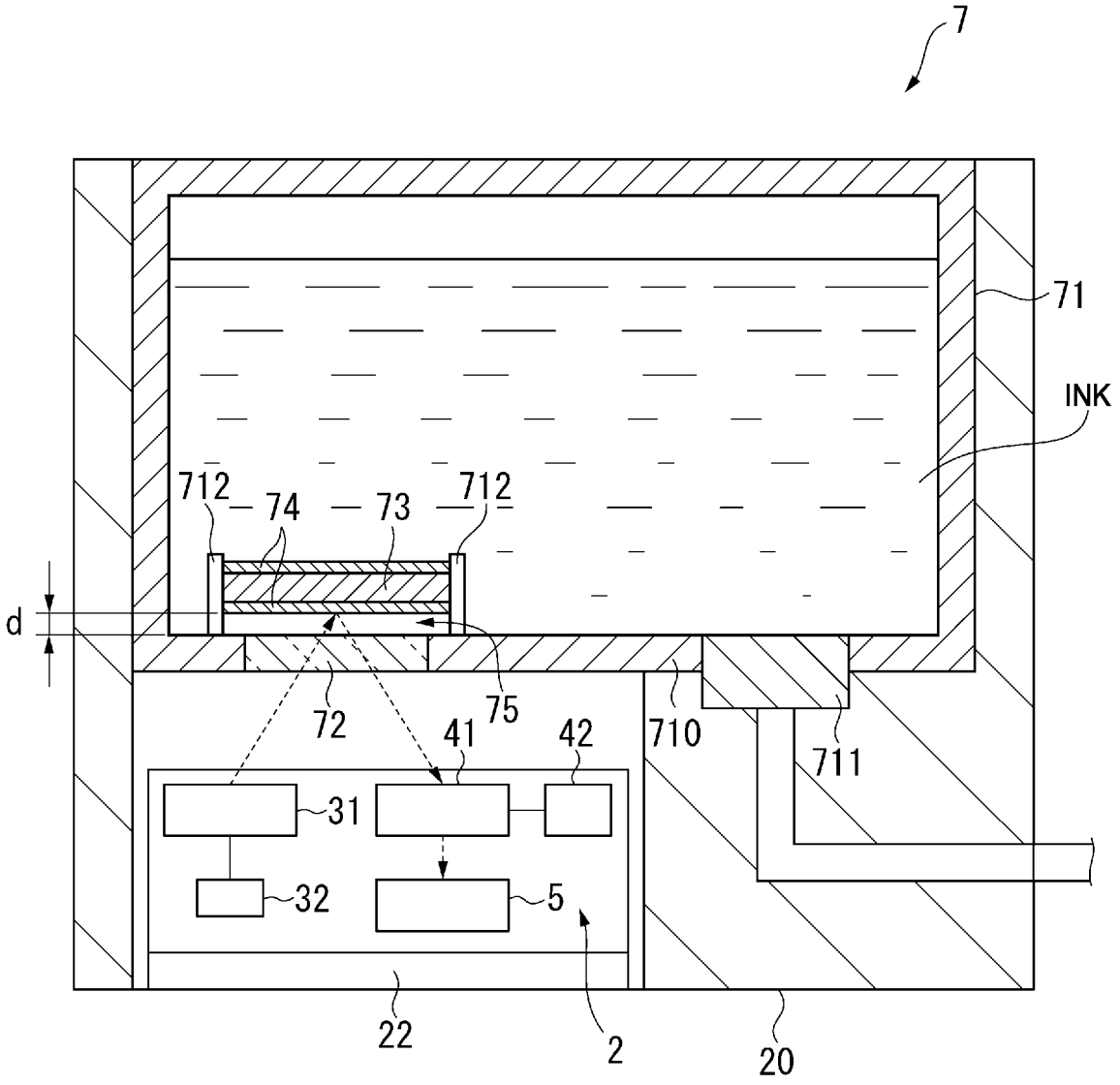
FIG. 2 is a cross-sectional view diagrammatically showing an ink cartridge and a cartridge incorporating section in the embodiment.

A plurality of ink cartridges 7 are attachably and detachably incorporated in the cartridge incorporating section 20. FIG. 2 shows one ink cartridge 7 representative for the plurality of ink cartridges 7.

In the printer 1 according to the present embodiment, the cartridge incorporating section 20 is provided in a printer main body (not shown) that movably holds a carriage on which an ink ejecting head is mounted. The ink cartridges 7 incorporated in the cartridge incorporating section 20 each supply the ink ejecting head mounted on the carriage with the ink via a tube and other components.

The measurement device 2 is so disposed as to face any of the ink cartridges 7 in the cartridge incorporating section 20. For example, the measurement device 2 may be movable with the aid of a movement mechanism 22 to each of the positions facing the plurality of ink cartridges 7. Instead, a plurality of measurement devices 2 may be disposed in correspondence with the plurality of ink cartridges 7. The following description will be made of a case where the measurement device 2 is so disposed as to face an arbitrary ink cartridge 7 by way of example.

The measurement device 2 includes a light source 31, a light source drive circuit 32, a wavelength variable etalon 41, an etalon drive circuit 42, and a light receiver 5.

The light source 31 includes a plurality of LEDs that each emit light that belongs to a visible light region (from 380 to 780 nm) or a near-infrared light region (from 1100 to 2500 nm) and radiates the ink cartridge 7 with the light. The light source drive circuit 32 turns on and off the LEDs in the light source 31 under the control of the control operation circuit 6.

The wavelength variable etalon 41 includes a pair of reflection films, an electrostatic actuator that changes the gap between the pair of reflection films, and other components. The wavelength variable etalon 41 transmits, out of the light reflected off the ink cartridge 7, light having a predetermined wavelength in accordance with the gap between the pair of reflection films.

The etalon drive circuit 42 applies drive voltage to the electrostatic actuator of the wavelength variable etalon 41 under the control of the control operation circuit 6 to change the gap between the pair of reflection films to change the wavelength of the light passing through the wavelength variable etalon 41.

The light receiver 5 includes a light receiving device 51, an IV conversion circuit 52, an amplification circuit 53, and an AD converter 54.

The light receiving device 51 is a photoelectric conversion device, such as a photodiode, receives the light having passed through the wavelength variable etalon 41, and outputs a light reception signal (current signal) according to the amount of received light.

The IV conversion circuit 52 is formed of an operational amplifier, a resistor, and a capacitor and converts the light reception signal outputted from the light receiving device 51 into a voltage signal from the current signal.

The amplification circuit 53 is formed of an inverting amplification circuit or a non-inverting amplification circuit using an operational amplifier, amplifies the voltage signal outputted from the IV conversion circuit 52, and outputs the amplified voltage signal.

The AD converter 54 converts the voltage signal amplified by the amplification circuit 53 into a digital signal from the analog signal and outputs the digital signal to the control operation circuit 6.

The control operation circuit 6 includes, for example, a microcontroller and a memory and controls the overall action of the printer 1.

The control operation circuit 6 executes a program stored in the memory to function as an etalon controller 61, a calculator 62, a quality evaluator 63, and a color corrector 65.

The etalon controller 61 reads from a storage 66 drive voltage corresponding to the wavelength of the light that is allowed to pass through the wavelength variable etalon 41 and controls the etalon drive circuit 42 based on the drive voltage. The etalon controller 61 further controls the etalon drive circuit 42 based on set measurement wavelength ranges (visible light region and near-infrared light region) in such a way that the drive voltage is changed by a predetermined amount.

The calculator 62 calculates a reflection spectrum over each of the measurement wavelength ranges based on the light reception signal inputted from the light receiver 5. Further, the calculator 62 converts the calculated reflection spectrum into a concentration spectrum, normalizes the concentration spectrum, and converts the normalized concentration spectrum back into a reflection spectrum (normalized reflection spectrum).

The quality evaluator 63 evaluates based on the normalized reflection spectrum whether or not the color or components of the ink in the ink cartridge 7 show abnormality (difference in components from intended components or in concentration from intended value, for example). In a case where the result of the evaluation shows that the color or components of the ink show abnormality, the quality evaluator 63 causes the storage 66 to store abnormality information representing the abnormality.

The color corrector 65 calculates correction information for reproducing a normal printed color based on the abnormality information stored in the storage 66.

The control operation circuit 6 further includes the storage 66, which is formed of a memory. The storage stores a drive table that relates the drive voltage applied to the electrostatic actuator in the wavelength variable etalon 41 to the amount of gap of the wavelength variable etalon 41 (or wavelength of light that passes through wavelength variable etalon 41). The storage 66 can further store the abnormality information detected by the quality evaluator 63, the correction information calculated by the color corrector 65, and other pieces of information.

Configuration of Ink Cartridge

The configuration of each of the ink cartridges 7 will next be described with reference to FIG. 2.

The ink cartridges 7 are each the ink tank according to an aspect of the invention and each include a tank main body 71, which contains ink, a transparent member 72, which forms part of the tank main body 71, a reference plate 73, which is disposed in the tank main body 71, and a pair of transparent substrates 74, which sandwich the reference plate 73.

The tank main body 71 is formed of a container-shaped element that contains ink, and a bottom section 710 of the tank main body 71 is provided with an ink supplier 711 for supplying the printer 1 with the ink. When the ink cartridge 7 is incorporated in the cartridge incorporating section 20, the bottom section 710 faces downward in the vertical direction.

An opening is formed in the bottom section 710 of the tank main body 71, and the transparent member 72 is so provided as to close the opening. The transparent member 72 is made of a material that can transmit the light from the light source 31 and transmits the light into the tank main body 71 and out thereof.

The reference plate 73 is a plate having reflectance known for each wavelength (18% standard plate or white reference plate, for example) and is made of a ceramic material, an enamel material, a plastic material, or any other material. The reference plate 73 is supported, for example, by a plurality of support members 712, which protrude from the bottom section 710 of the tank main body 71, and is therefore so located as to face the transparent member 72.

The pair of transparent substrates 74 are made of a material that can transmit the light from the light source 31. The pair of transparent substrates 74 are in intimate contact with the opposite surfaces of the reference plate 73 to prevent an effect of the solvent of the ink and other substances on the reference plate 73. The transparent substrates 74 can each, for example, be a quartz crystal substrate having strong resistance to the effect of the solvent.

In the thus configured ink cartridge 7, an inflow space 75, into which the ink in the tank main body 71 flows, is formed between the reference plate 73 and the transparent member 72 (more specifically, between the transparent substrate 74 facing the bottom section 710 and transparent member 72). The width d of the inflow space 75 is several micrometers in the direction perpendicular to the reference plate 73. Specifically, the width d of the inflow space 75 is preferably greater than or equal to 0.2 μm and smaller than or equal to 5.0 μm, more preferably greater than or equal to 2.0 μm.

Ink Measuring Method

Figure 3:
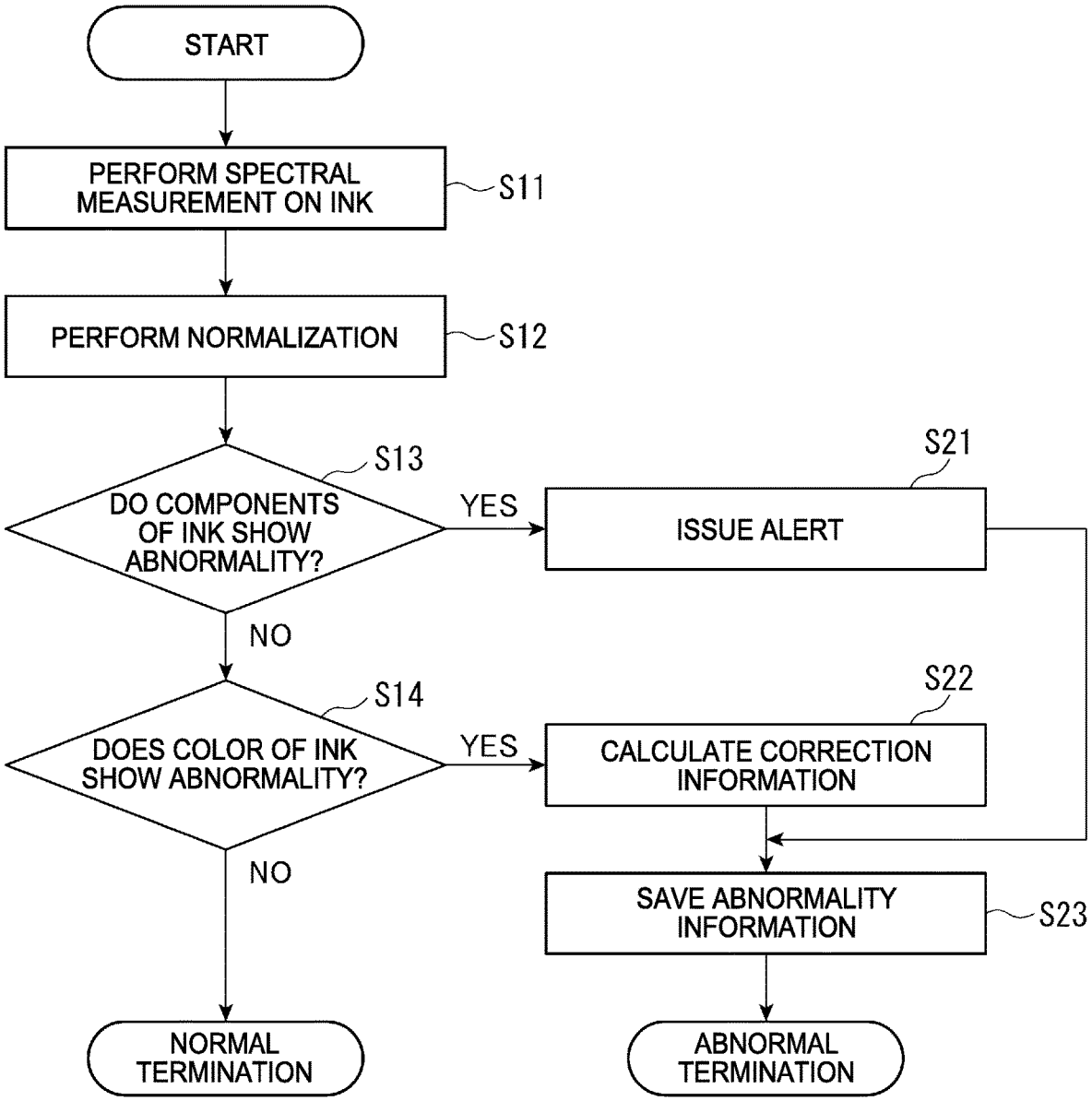
FIG. 3 is a flowchart showing an ink measuring method according to the embodiment.

An ink measuring method according to the present embodiment will be described with reference to the flowchart in FIG. 3. The ink measuring method according to the present embodiment starts at the timing when the ink cartridge 7 is incorporated in the printer 1. For example, the ink measuring method starts when any of the ink cartridges 7 in the printer 1 is exchanged.

Spectral measurement is first performed on the ink in any of the ink cartridges 7 (step S11: measurement step). Specifically, the light source 31 is driven by the light source drive circuit 32 and radiates visible light and near-infrared light. During the radiation, the etalon drive circuit 42 changes the drive voltage applied to the wavelength variable etalon 41 to change the wavelength of the light that passes through the wavelength variable etalon 41 by a predetermined amount. The calculator 62 calculates a reflection spectrum in each of the measurement wavelength ranges (visible light region and near-infrared light region) based on the light reception signal inputted from the light receiver 5.

After step S11, the calculator 62 normalizes the calculated reflection spectrum to calculate a normalized reflection spectrum (step S12).

Specifically, the reflection spectrum is first converted into a concentration spectrum by using the following Expression (1). In Expression (1), R represents the reflectance, and D represents the concentration.

$$D=-log_{10}R \quad \text{Expression (1)}$$

A wavelength which corresponds to a foot of the peak-containing curve of the concentration spectrum and at which the gradient of the graph is maximized (or wavelength at which concentration peak is halved) is used as a reference wavelength, and the concentration spectrum is so multiplied by a constant that the concentration at the reference wavelength is one. The normalization is thus performed.

The normalized concentration spectrum is then converted back to a reflection spectrum by using the following Expression (2). In Expression (2), R represents the reflectance, and D represents the concentration.

$$R=10^{-D} \quad \text{Expression (2)}$$

The reflection spectrum reconverted by Expression (2) is a normalized reflection spectrum representing the spectral distribution of normalized reflectance.

Figure 4:
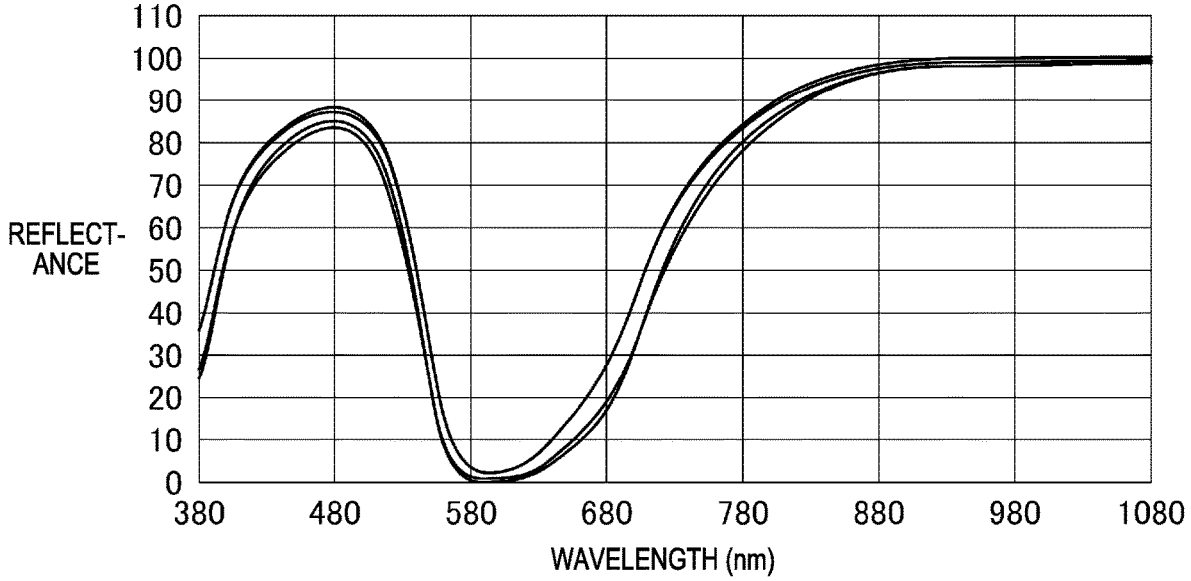
FIG. 4 shows graphs illustrating exemplary reflection spectra before normalization.

For example, FIG. 4 shows a plurality of exemplary reflection spectra (in visible light range) measured for cyan ink by changing the inclination of the installed printer 1 and the amount of remaining ink in the ink cartridge 7. In FIG. 4, the plurality of reflection spectra vary although the amount of the variation is small.

Figure 5:
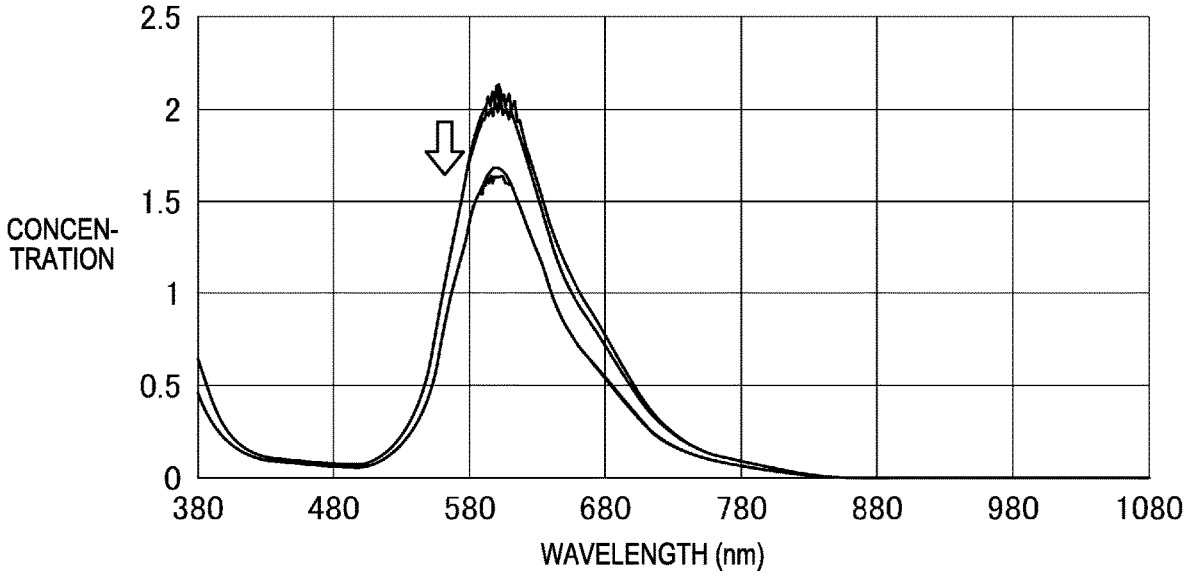
FIG. 5 shows graphs illustrating exemplary concentration spectra before normalization.
Figure 6:
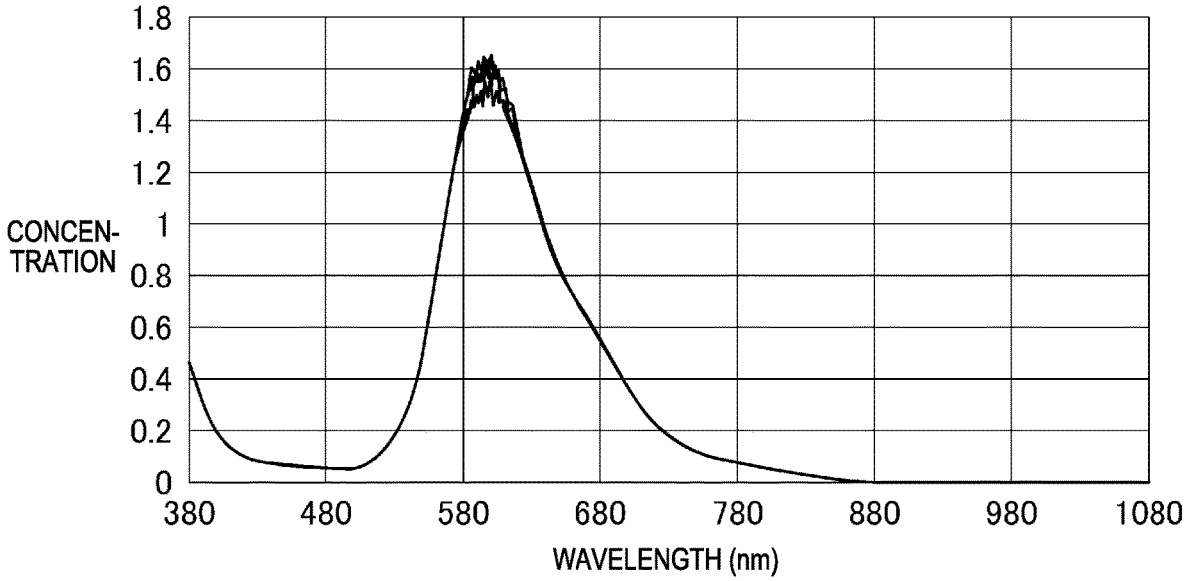
FIG. 6 shows graphs illustrating exemplary normalized concentration spectra.

FIG. 5 shows an example in which the reflection spectra shown in FIG. 4 are converted into concentration spectra, and FIG. 6 shows an example in which the concentration spectra in FIG. 5 are normalized. In FIGS. 5 and 6, the reference wavelength used in the normalization is set at a value close to 550 nm.

Figure 7:
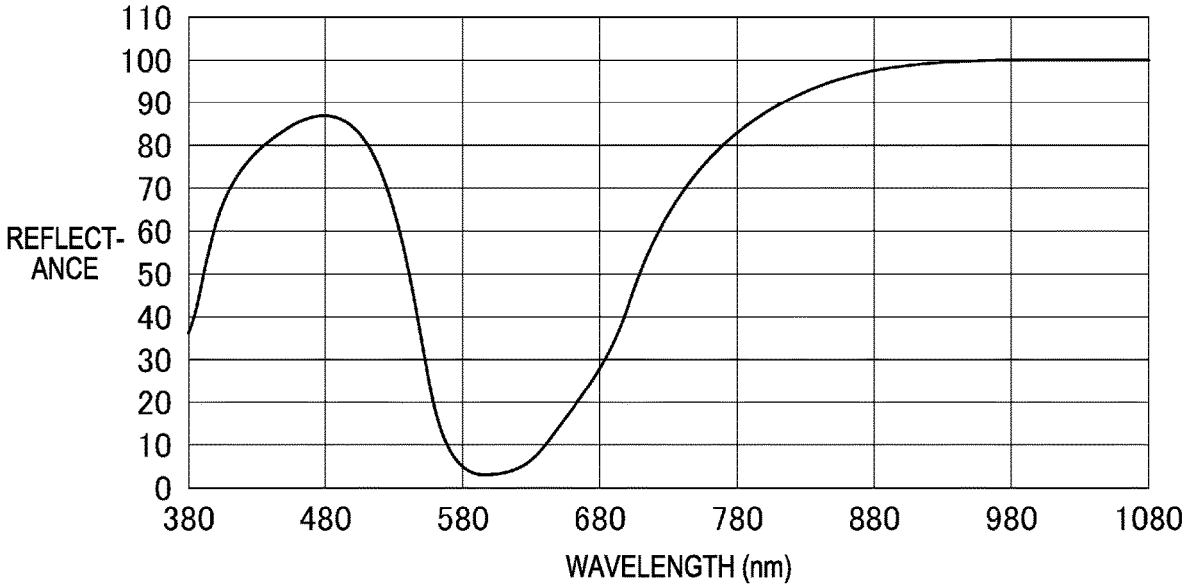
FIG. 7 shows graphs illustrating exemplary normalized reflection spectra.

FIG. 7 shows an example in which the concentration spectra shown in FIG. 6 are converted back to reflection spectra. The normalized reflection spectra shown in FIG. 7 demonstrate that the inter-reflection-spectra variation shown in FIG. 4 is removed.

FIGS. 4 to 7 show the normalization of reflection spectra in the visible light region by way of example, and the same holds true for the normalization of reflection spectra in the near-infrared light region.

After step S12, the quality evaluator 63 evaluates based on a normalized reflection spectrum in the near-infrared light region whether or not the components of the ink show abnormality (step S13: evaluation step). For example, the quality evaluator 63 evaluates whether or not reflectance that does not fall within a reference range has been detected in the normalized reflection spectrum. In a case where reflectance that does not fall within the reference range has been detected, the quality evaluator 63 determines that the components of the ink show abnormality (difference).

In the case where the result of the evaluation in step S13 shows that the components of the ink show abnormality, the quality evaluator 63, for example, causes a display section (not shown) of the printer 1 to display an alert (step S21). Examples of the alert may include notification of a risk of failure to the user and a request of the user to exchange to a new ink cartridge 7.

The quality evaluator 63 then saves information representing the abnormality of the reflection spectrum in the near-infrared light region (abnormality information) in the storage 66 (step S23).

On the other hand, in a case where the result of the evaluation in step S13 shows that the components of the ink show no abnormality, the quality evaluator 63 evaluates based on a reflection spectrum in the visible light region whether or not the color of the ink shows abnormality (step S14: evaluation step). Specifically, the quality evaluator 63 evaluates whether or not the reflectance at a wavelength for color evaluation does not fall within a reference range in the normalized reflection spectrum. In a case where the reflectance at the wavelength for color evaluation does not fall within the reference range, the quality evaluator 63 determines that the color of the ink shows abnormality (difference in components from intended components or difference in concentration from intended value, for example).

Figure 8:
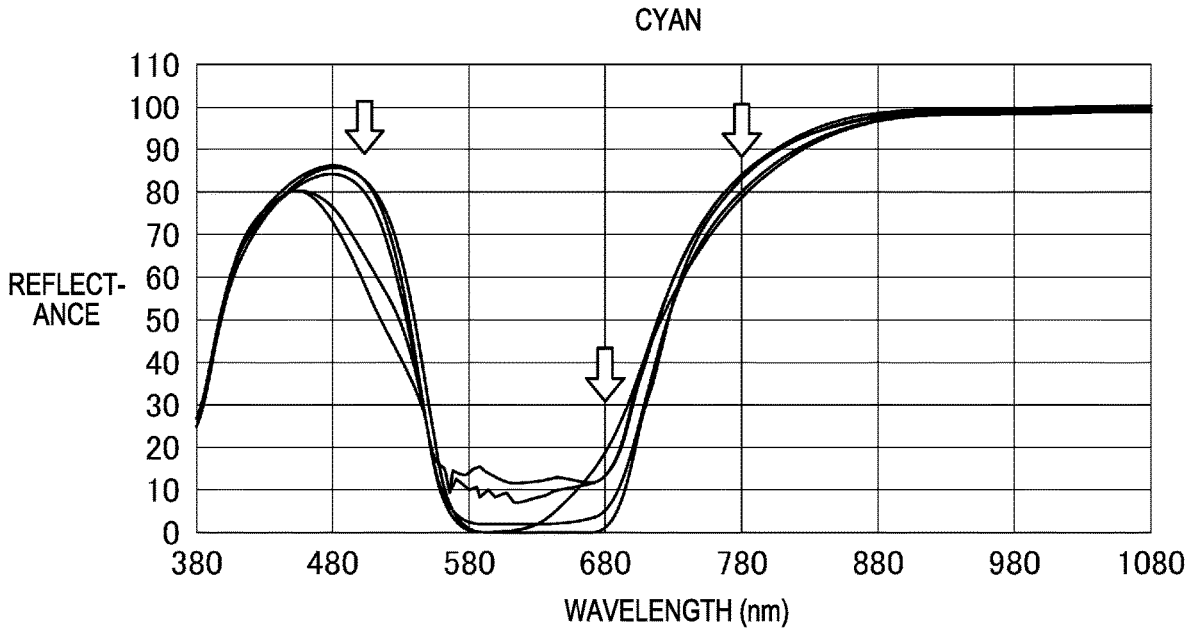
FIG. 8 shows graphs illustrating exemplary normalized reflection spectra for cyan ink.
Figure 9:
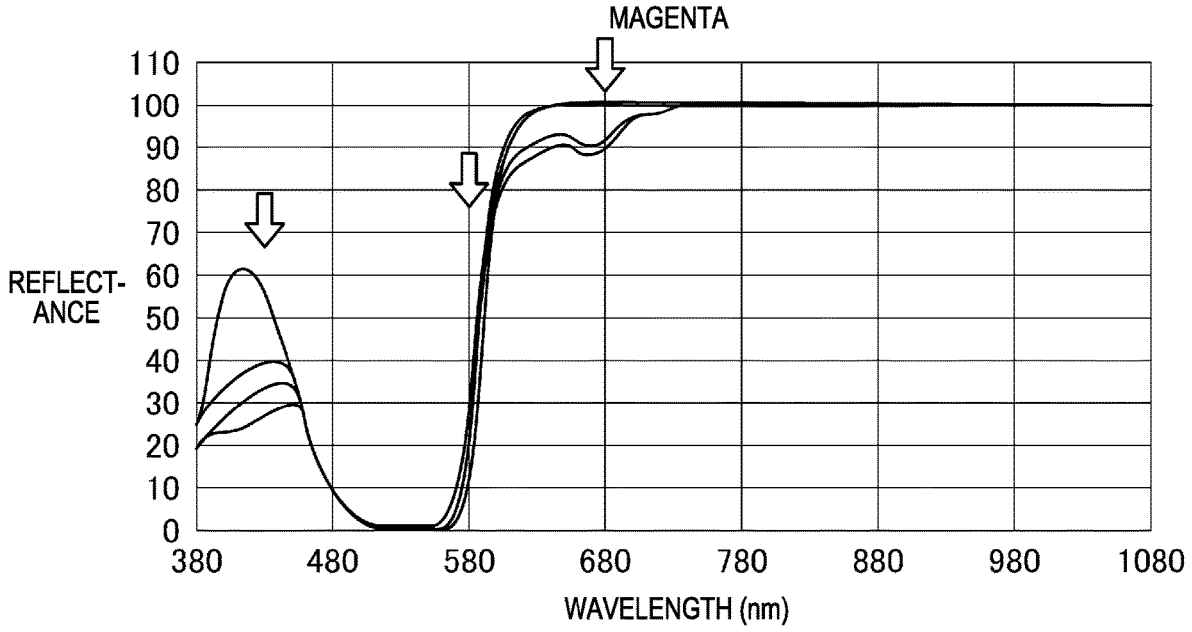
FIG. 9 shows graphs illustrating exemplary normalized reflection spectra for magenta ink.
Figure 10:
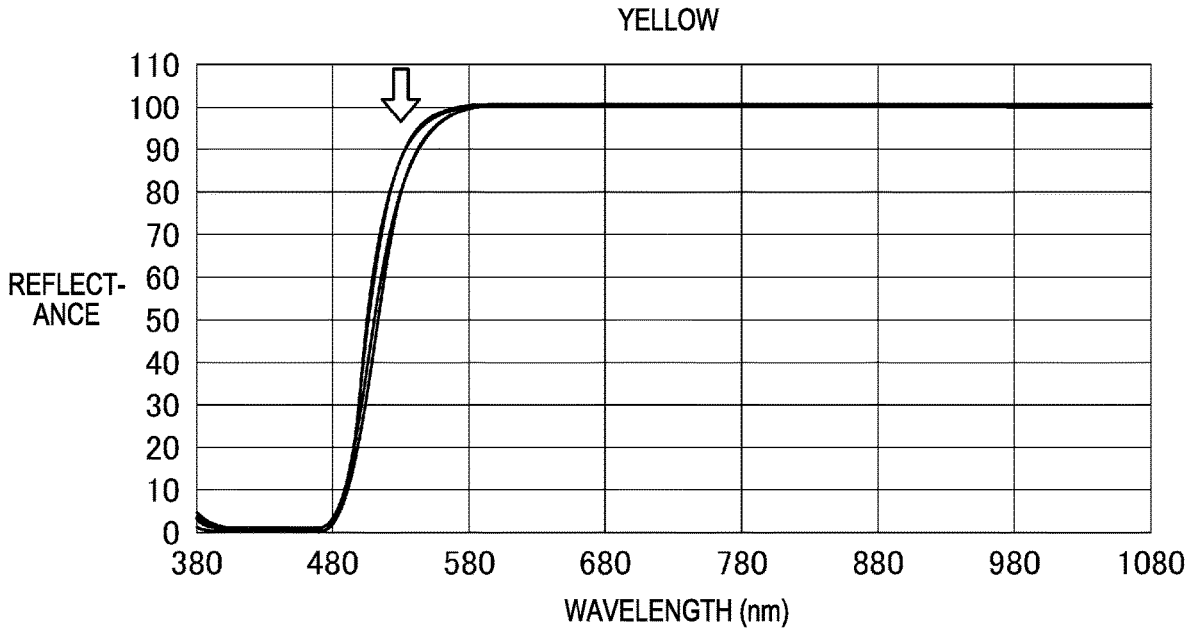
FIG. 10 shows graphs illustrating exemplary normalized reflection spectra for yellow ink.
Figure 11:
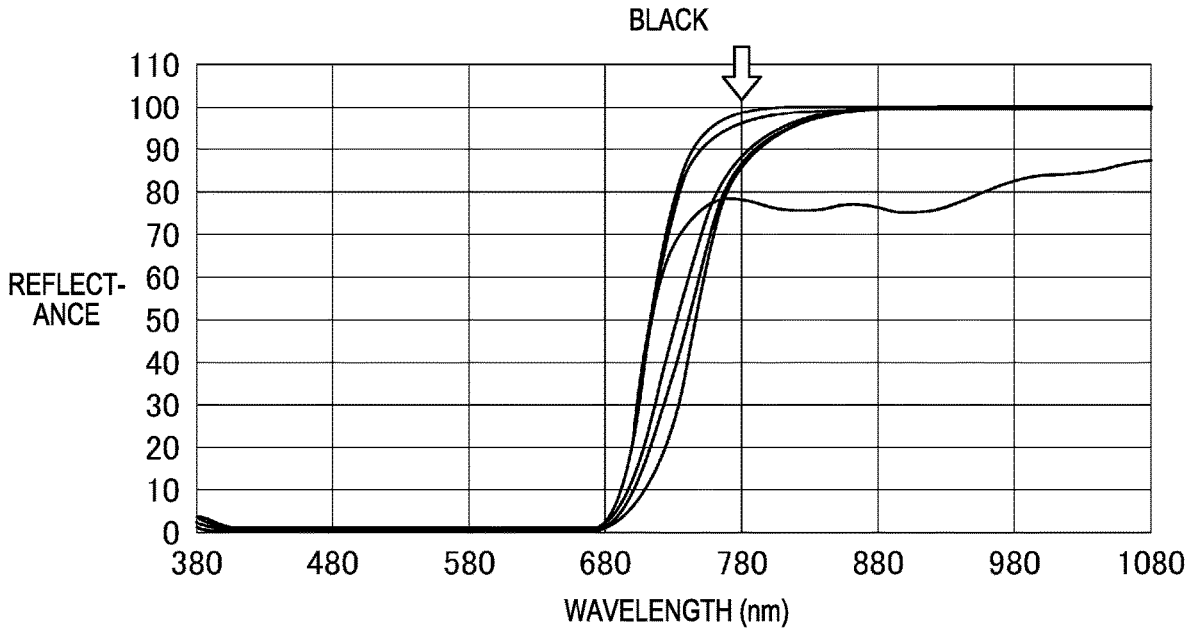
FIG. 11 shows graphs illustrating exemplary normalized reflection spectra for black ink.

The wavelength for color evaluation is a wavelength at which a change in the color of the ink causes a significant difference in the shape of a reflection spectrum, and the wavelength for color evaluation is set on a standard color basis. For example, the wavelength for color evaluation used to evaluate cyan (and light cyan) is set at at least any one of 500 nm, 680 nm, and 780 nm and in the vicinity thereof (see FIG. 8). The wavelength forFi color evaluation used to evaluate magenta (and light magenta) is set at at least any one of 420 nm, 580 nm, and 680 nm and in the vicinity thereof (see FIG. 9). The wavelength for color evaluation used to evaluate yellow is set at 520 nm and in the vicinity thereof (see FIG. 10). The wavelength for color evaluation used to evaluate black is set at 780 nm and in the vicinity thereof (see FIG. 11).

In a case where the result of the evaluation in step S14 shows that the color of the ink shows abnormality, the color corrector 65 calculates correction data for printing a normal color based on the normalized reflection spectrum (step S22). The quality evaluator 63 then saves information representing the abnormality of the reflection spectrum in the visible light region (abnormality information) in the storage 66 (step S23).

On the other hand, in a case where the result of the evaluation in step S14 shows that the color of the ink shows no abnormality, the flowchart normally ends.

The ink measuring method according to the present embodiment thus ends. The abnormality information stored in the storage 66 can be used to repair the printer 1 when it is defective.

Effects of Present Embodiment (1) In each of the ink cartridges 7 in the present embodiment, the inflow space 75 is formed between the transparent member 72 and the reference plate 73 of the tank main body 71. Therefore, the ink having flowed into the inflow space 75 can be irradiated with light through the transparent member 72, and the light reflected off the reference plate 73 can be detected through the transparent member 72 for measurement of the color and components of the ink.

According to the present embodiment, since no ink absorber in the related art is used, the inherent color and components of the ink can be accurately measured.

(2) In each of the ink cartridges 7 in the present embodiment, the width d of the inflow space 75, into which the ink flows, is preferably greater than or equal to 0.2 μm and smaller than or equal to 5.0 μm.

In general, the particles of ink used in an inkjet printer has a size of about 0.2 μm at the maximum. Therefore, setting the width of the inflow space 75 at a value greater than or equal to 0.2 μm can prevent the inflow space 75 from being clogged with the ink particles.

Further, ink used in a typical inkjet printer has poor optical transmittance even in a case where the ink has a pale color but in a case where the ink has a film thickness greater than 5.0 μm. In view of the fact described above, in the present embodiment, the width d of the ink-inflow space 75 (film thickness of ink that flows into inflow space 75) is set at a value smaller than or equal to 5.0 μm. The amount of light reflected off the reference plate 73 can thus be large enough for the measurement of the accurate color of the reflected light.

Therefore, in the present embodiment, the color of the ink in any of the ink cartridges 7 can be accurately and reliably measured.

(3) In each of the ink cartridges 7 in the present embodiment, the width d of the inflow space 75, into which the ink flows, is preferably greater than or equal to 2.5 μm.

In general, ink used in a typical inkjet printer has a relatively linear relationship between the concentration and the film thickness of the ink. However, when the film thickness of the ink is greater than or equal to a certain value, the linearity does not hold, and the concentration is fixed. Specifically, the concentration increases in proportion to the film thickness of the ink when the film thickness is smaller than or equal to 1.0 μm, but the rate of the increase in the concentration versus the film thickness gradually decreases after the film thickness is greater than 1.0 μm, and the concentration versus the film thickness is fixed when the film thickness is greater than or equal to 2.5 μm (concentration is saturated).

Therefore, setting the width d of the inflow space (film thickness of ink flowing into inflow space 75) at a value greater than or equal to 2.5 μm causes the concentration of the ink in the inflow space 75 to be saturated and therefore allows measurement with a small amount of variation.

(4) In any of the ink cartridges 7 in the present embodiment, the transparent member 72 is disposed at the bottom section 710 of the tank main body 71. That is, the ink-inflow space 75 is formed on the side facing the bottom section 710 of the tank main body 71. Therefore, even when the ink in the ink cartridge 7 has decreased, the ink readily flows into the space between the transparent member 72 and the reference plate 73 disposed at the bottom section 710 of the tank main body 71, whereby the color and components of the ink can be more reliably measured.

(5) In any of the ink cartridges 7 in the present embodiment, the reference plate 73 is sandwiched between the pair of transparent substrates 74. The configuration described above can prevent the effect of the solvent of the ink and other substances on the reference plate 73, whereby deterioration of the reference plate 73 can be avoided. The color and components of the ink in the ink cartridge 7 can therefore be accurately measured for a long period.

(6) The ink measuring system 100 according to the present embodiment, which includes the ink cartridges 7 described above, can accurately evaluate the ink in any of the ink cartridges 7 and can therefore appropriately manage the quality of the ink.

For example, in the case where the color of the ink shows abnormality, correction data for printing a normal color can be calculated for reproducible printing. Further, in the case where the components of the ink show abnormality, an alert can be issued to the user to prevent failure of the printer 1.

(7) The ink measuring system 100 according to the present embodiment, which normalizes a reflection spectrum, can invariably evaluate the ink even in the case where the inclination of the installed printer 1 and the amount of remaining ink in any of the ink cartridges 7 vary.

(8) The ink measuring method according to the present embodiment, in which the ink cartridges 7 described above are used, allows accurate evaluation of the ink in any of the ink cartridges 7 and can therefore appropriately manage the quality of the ink.

Variations

The invention is not limited to the embodiment described above, and variations, improvements, and other modifications to the extent that the advantage of the invention is achieved fall within the scope of the invention.

In each of the ink cartridges 7 in the embodiment described above, the transparent member 72 is disposed at the bottom section 710 of the tank main body 71. For example, the transparent member 72 may instead be disposed at a sidewall portion or any other portion of the tank main body 71. Further, in the embodiment described above, the transparent member 72 forms part of the tank main body 71 and may instead form the entire tank main body 71.

In each of the ink cartridges 7 in the embodiment described above, the reference plate 73 is sandwiched between the pair of transparent substrates 74, but not necessarily in the invention. For example, in a case where the reference plate 73 itself is made of a material highly resistance to the effect of the ink, the reference plate 73 may not be sandwiched between the pair of transparent substrates 74.

The ink cartridges 7 in the embodiment described above are each an off-carriage-type ink cartridge and may instead be an on-carriage-type ink cartridge, which is mounted on the carriage.

The ink tank according to an aspect of the invention is not limited to the ink cartridges 7 and can be an ink tank in a variety of other aspects including a pack and a bottle.

In the embodiment described above, the ink measurement starts at the timing when the ink cartridge 7 is incorporated in the printer 1, but the timing at which the ink measuring method according to the embodiment of the invention starts is not limited to the timing described above. For example, the ink measurement may be performed whenever a fixed period elapses after the ink cartridge 7 is incorporated in the printer 1.

In the embodiment described above, the calculator calculates a reflection spectrum and may instead calculate reflectance of light having the wavelength for evaluation.

In the embodiment described above, the color and components of the ink in any of the ink cartridges 7 are evaluated. Instead, one of the color and components of the ink may be evaluated. Still instead, the amount of remaining ink may be calculated from the concentration of the ink in any of the ink cartridges 7 concurrently with the measurement of the color or components of the ink.

In the embodiment described above, the spectral measurement is performed on the light reflected off any of the ink cartridges 7 by using the wavelength variable etalon 41. Instead, measurement using a color sensor or any other sensor may be performed on the reflected light.

In the embodiment described above, the printer 1 has been presented as the ink measuring apparatus according to an aspect of the invention by way of example, but not necessarily. For example, the ink measuring apparatus may be a measuring apparatus that only measures the ink in any of the ink cartridges 7.

The entire disclosure of Japanese Patent Application No. 2018-013703 filed on Jan. 30, 2018 is expressly incorporated by reference herein.

What is claimed is:

1. An ink tank comprising:

a tank main body that contains ink;

a transparent member that forms at least part of the tank main body and transmits light;

a reference plate that is disposed in the tank main body and in a position facing the transparent member and forms, along with the transparent member, an inflow space which is located between the transparent member and the reference plate and into which the ink flows; and a pair of transparent substrates that sandwich the reference plate.

2. The ink tank according to claim 1, wherein a width of the inflow space in a direction perpendicular to the reference plate is greater than or equal to 0.2 μm and smaller than or equal to 5.0 μm.

3. The ink tank according to claim 1, wherein the transparent member is disposed at a bottom section of the tank main body.

* * * * *